US008657625B2

(12) United States Patent
Wagata et al.

(10) Patent No.: US 8,657,625 B2
(45) Date of Patent: Feb. 25, 2014

(54) CONNECTOR AND SEMICONDUCTOR TEST DEVICE

(75) Inventors: Hirotaka Wagata, Tokyo (JP); Shin Sakiyama, Tokyo (JP); Hiroyuki Hama, Tokyo (JP); Teruhito Suzuki, Kanagawa (JP); Hiroyuki Yajima, Kanagawa (JP); Akinori Mizumura, Kanagawa (JP)

(73) Assignees: Molex Japan Co., Ltd., Yamato (JP); Advantest Corporation, Tokyo (JP)

( * ) Notice: Subject to any disclaimer, the term of this patent is extended or adjusted under 35 U.S.C. 154(b) by 20 days.

(21) Appl. No.: 13/557,347

(22) Filed: Jul. 25, 2012

(65) Prior Publication Data

US 2013/0189866 A1 Jul. 25, 2013

(30) Foreign Application Priority Data

Jul. 25, 2011 (JP) ..... 2011-162278

(51) Int. Cl.
*H01R 9/05* (2006.01)

(52) U.S. Cl.
USPC ..... 439/581; 439/578

(58) Field of Classification Search
USPC ..... 439/607.2, 607.23, 581, 578
See application file for complete search history.

(56) References Cited

U.S. PATENT DOCUMENTS 4,795,352 A * 1/1989 Capp et al. ..... 439/63
5,055,068 A * 10/1991 Machura et al. ..... 439/581
5,662,480 A * 9/1997 Togashi ..... 439/63
5,718,607 A * 2/1998 Murphy et al. ..... 439/579
6,254,430 B1 * 7/2001 Endo et al. ..... 439/578
6,443,740 B1 * 9/2002 Evans ..... 439/63
6,450,836 B1 * 9/2002 Youtsey ..... 439/620.03
6,644,994 B1 * 11/2003 Lee ..... 439/181
6,780,051 B2 * 8/2004 Otsu ..... 439/578
7,946,853 B2 * 5/2011 Breinlinger et al. ..... 439/63
8,057,257 B2 * 11/2011 Chen et al. ..... 439/581
2009/0203259 A1 * 8/2009 Nguyen et al. ..... 439/607.23
2010/0003851 A1 * 1/2010 Akama et al. ..... 439/578

FOREIGN PATENT DOCUMENTS

JP 2009-016072 1/2009

* cited by examiner

*Primary Examiner* — Briggitte R Hammond
(74) *Attorney, Agent, or Firm* — Timothy M. Morella

(57) ABSTRACT

A connector includes a signal terminal, an insulating member, a ground terminal and an enclosure. The signal terminal has a main body extending in one direction, and a contact arm provided on each side of the main body for contacting another conductor. The insulating member encloses the main body. The ground terminal has a cylindrical main body enclosing the insulating member, and a contact arm provided on each side of the cylindrical main body for contacting another conductor. The cylindrical main body includes first and second semi-cylindrical parts, each having semi cylindrical shapes. The semi-cylindrical parts make a cylindrical shape as a whole by both end parts of the circumferential direction being assembled so as to mutually overlap. An insertion hole is formed in the enclosure where an assembly of the signal element, the insulating member and the ground terminal are inserted.

13 Claims, 14 Drawing Sheets

CONNECTOR AND SEMICONDUCTOR TEST DEVICE

REFERENCE TO RELATED APPLICATIONS

The Present Disclosure claims priority to prior-filed Japanese Patent Application No. 2011-162278, entitled "Connector and Semiconductor Test Device," filed on 25 Jul. 2011 with the Japanese Patent Office. The content of the aforementioned Patent Application is incorporated in its entirety herein.

BACKGROUND OF THE PRESENT DISCLOSURE

The Present Disclosure relates, generally, to a connector and semiconductor test device, and, more particularly, to a coaxial structure having a signal terminal and ground terminal.

Connectors for connecting a coaxial cable to a circuit board are known. Such connectors generally have a signal terminal connected to a signal conductor of the coaxial cable, and a ground terminal connected to a ground conductor of the coaxial cable. An example of this type of connector is disclosed in Japanese Patent Application No. 2007-174010, the content of which is incorporated herein in its entirety. The '010 Application ostensibly discloses a connector having a coaxial structure in which the signal terminal is enclosed by the ground terminal and an insulating member is arranged therebetween. However, in this connector, there is a risk that variance may occur in the size of the gap formed between the signal terminal and the insulating member and the size of the gap formed between the ground terminal and the insulating member. In such case, a variance is generated in the impedance of the signal terminals, thereby causing risk of degradation in signal transmission properties.

SUMMARY OF THE PRESENT DISCLOSURE

An objective of the Present Disclosure is to provide a connector that can improve signal transmission properties and a semiconductor test device.

In order to resolve the aforementioned problems, the connector of the Present Disclosure provides a signal terminal, an insulating member, a ground terminal and an enclosure. The signal terminal has a main body that extends in one direction and a contact arm provided on each side of the extension direction of the main body for contacting another conductor. The insulating member is arranged to enclose the main body part of the signal terminal. The ground terminal has a cylindrical main body in a cylindrical shape arranged to enclose the insulating member and a contact arm provided on each side of the center axis direction of the cylindrical main body for contacting another conductor. The cylindrical main body includes a first semi cylindrical part and a second semi cylindrical part having semi cylindrical shapes. The first semi cylindrical part and the second semi cylindrical part make a cylindrical shape as a whole by both end parts of the circumferential direction being assembled so as to mutually overlap. An insertion hole is formed in the enclosure where an assembly of the signal element, the insulating member and the ground terminal are inserted.

Additionally, the first semi cylindrical part fits with the insulating member in a flexibly deformed state such that the gaps of both end parts of the circumferential direction are widened. Further, the second semi cylindrical part fits with the insulating member that is fit with the first semi cylindrical part, in a flexibly deformed state such that the gaps of both end parts of the circumferential direction are widened. Also, a slope is provided on the inner side of the insertion hole of the enclosure that guides at least one of the first semi cylindrical part or the second semi cylindrical part as the insertion of the assembly advances so that the gaps of the mutual center parts of the circumferential direction of the first semi cylindrical part and the second semi cylindrical part narrow.

In addition, a performance board of the Present Disclosure provides a connector as described above. In addition, a motherboard of the Present Disclosure provides a connector as described above. In addition, a semiconductor test device of the Present Disclosure provides a connector as described above.

According to the Present Disclosure, the size of the gap formed between the ground terminal and the insulating member can be reduced, and the variance in the size of the gap can be suppressed. Thereby, variance in impedance can be suppressed, and signal transmission properties can be improved.

Furthermore, in one mode of the Present Disclosure, the slope contacts the first semi cylindrical part, and guides the first semi cylindrical part towards the second semi cylindrical part. Thereby, further widening by the gap of both end parts of the circumferential direction of the second semi cylindrical part can be suppressed, and the size of the gap formed between the ground terminal and the insulating member can be reduced.

In addition, in one mode of the Present Disclosure, a stopper is provided on the inner side of the insertion hole of the enclosure, regulating the movement of the second semi cylindrical part to the first semi cylindrical part. Thereby, because the position of each member is determined by the second semi cylindrical part as a reference, position accuracy of the signal terminal and the ground terminal can be improved.

Also, in one mode of the Present Disclosure, a pawl part that penetrates into the stopper is provided at both end parts of the circumferential direction of the second semi cylindrical part. Thereby, the ejection of the second semi cylindrical part from the insertion hole is suppressed.

Additionally, in one mode of the Present Disclosure, the contact arm is provided on the portion that overlaps with the second semi cylindrical part of the first semi cylindrical part and can flexibly deform to the outer side of the diameter direction. Thereby, the force that flexibly returns the contact arm to the inner side of the diameter direction can be improved.

Further, in one mode of the Present Disclosure, a raised part provided on an outer circumference surface of the insulating member or an inner circumference surface of the first semi cylindrical part is fitted into a recessed part provided on the other. Thereby, either the insulating member or the first semi cylindrical part can be suppressed from coming out from the insertion hole of the enclosure.

Finally, in one mode of the Present Disclosure, the insulating member is integrally molded with the signal terminal. Thereby, the insulating member can be sealed to the signal terminal without forming a gap there between. Thereby, variance in impedance can be suppressed, and signal transmission properties can be improved.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

For purposes of FIGS. 1-9, the insertion direction of the assembly 3 is the forward direction, the opposite direction thereof is a rearward direction, the direction in which the second semi cylindrical part 7 is arranged relative to the signal terminal 4 is the upward direction, and the direction in which the first semi cylindrical part 6 is arranged is the downward direction.

Figure 1A:
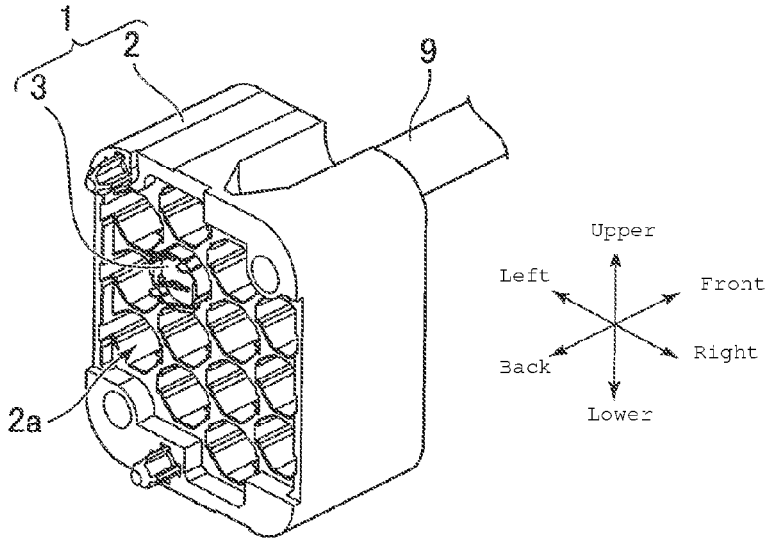
FIG. 1A is a perspective view a connector according to the Present Disclosure.
Figure 1B:
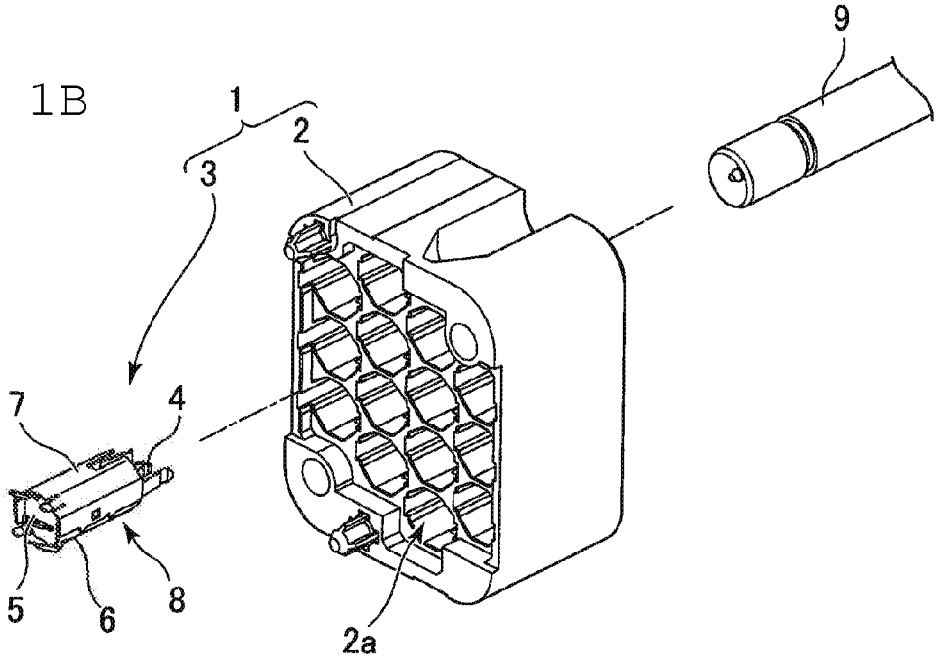
FIG. 1B is a blown up perspective view of the connector of FIG. 1A.

Referring to FIGS. 1-9, connector 1 illustrated in FIGS. 1A-B is provided with an enclosure 2 having a plurality of insertion holes 2*a* formed and an assembly 3 that inserts into each of the insertion holes 2*a*. A coaxial cable 9 connected to each assembly 3 is attached to the front side of the connector 1. A circuit board (not illustrated), connected to a plurality of assemblies 3, is attached to the back side of the connector 1. In the first embodiment, the connector 1 is arranged so that the back surface of the connector 1 and the top surface of the circuit board face each other.

The assembly 3 is provided with the signal terminal 4 that extends in the front to back direction, the insulating member 5 arranged to enclose the signal terminal 4, and the ground terminal 8 in a cylindrical shape arranged to enclose the insulating member 5. The ground terminal 8 includes the first semi cylindrical part and the second semi cylindrical part having semi cylindrical shapes and by assembling together make a cylindrical shape as a whole.

Figure 2A:
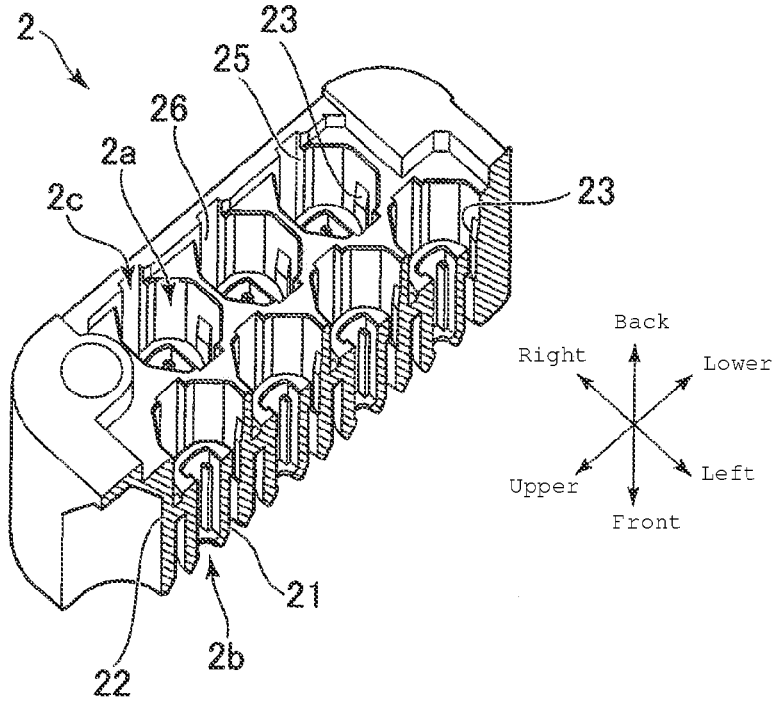
FIG. 2A is a perspective view of an enclosure included in the connector of FIG. 1A.
Figure 2B:
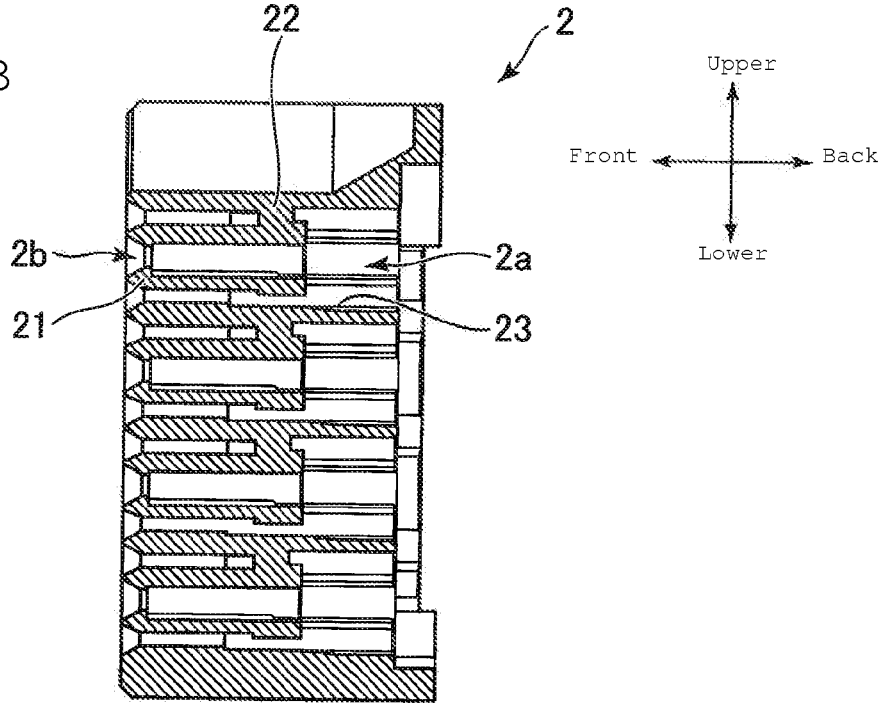
FIG. 2B is a cross-sectional view of the enclosure of FIG. 2A.

The enclosure 2 illustrated in FIGS. 2A-B is formed by an insulating material. A plurality of insertion holes 2*a* that penetrate through in the front to back direction are staggered in the enclosure 2. A cylindrically-shaped holding part 21 is arranged on the front half portion of the inner airspace of the insertion hole 2*a* separated from the inner wall of the insertion hole 2*a*. An insertion hole 2*b* that penetrates in the front to back direction is formed on the holding part 21. The holding part 21 is linked with the inner wall of the insertion hole 2*a* by a coupling 22.

A slope 23 slanted to face slightly upward facing forward is provided is provided on the downward surface of the inner wall of the insertion hole 2*a*. In other words, the slope 23 is slanted to approach the center axis of the insertion hole 2*a* facing forward. The slope 23 is positioned further rearward than the back surface of the holding part 21.

An expansion groove 2*c* that extends in the front to back direction is formed on each surface on the left and right of the inner wall of the insertion hole 2*a*, and corner parts 25, 26 are provided on both sides thereof. Of these, corner part 25 on the bottom side projects to the inner side of the insertion hole 2*a* more than the corner part 26 on the top side.

Figure 3:
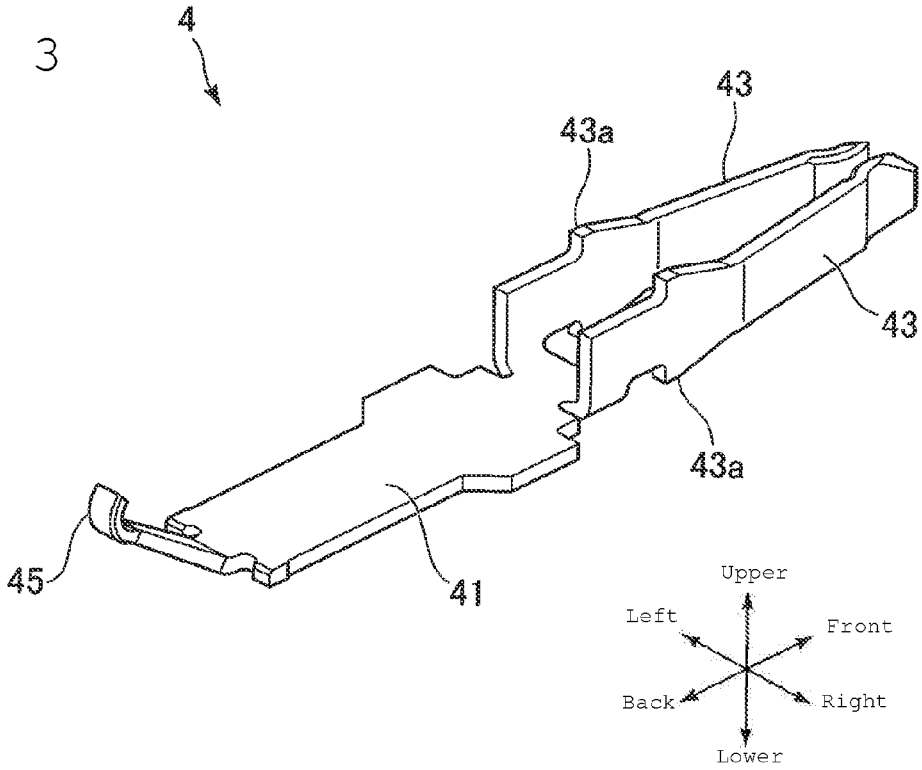
FIG. 3 is a perspective view of a signal terminal included in the connector of FIG. 1A.

The signal terminal 4 illustrated in FIG. 3 is made of a conductive material and formed by folding a stamped metal plate. The signal terminal 4 is provided with a main body part 41 that extends in the front to back direction, a pair of contact arms 43 provided on the front side of the main body part 41, and a contact arm 45 provided on the back side of the main body part 41. The pair of contact arm 43 provided on the front side can flexibly deform in a mutually separating direction and contact a signal conductor of the coaxial cable 9 illustrated in FIGS. 1A-B. A pawl part 43 projected upward and downward is provided on a midway part of each of the contact arms 43*a*. The contact arm 45 provided on the back side extends upward and rearward and contacts a conductor arranged on the surface of a circuit board not illustrated.

Figure 4A:
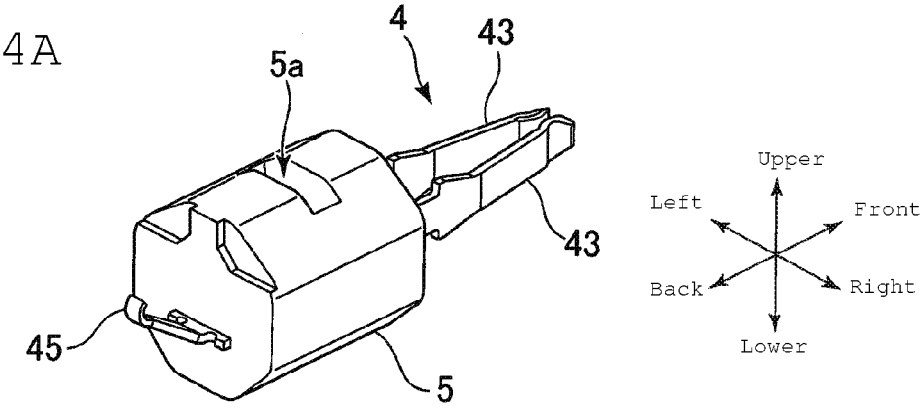
FIG. 4A is a perspective view of the signal terminal of FIG. 3 and an insulating member included in the connector of FIG. 1A.
Figure 4B:
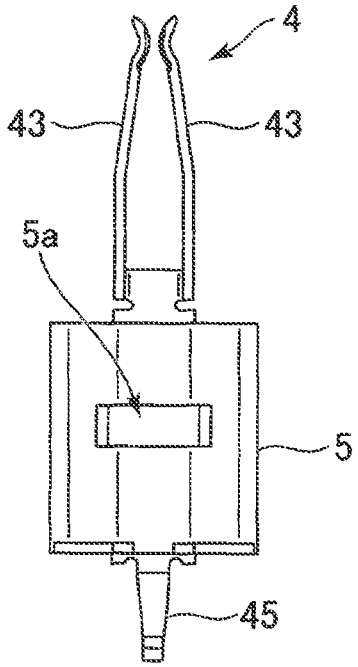
FIG. 4B is a plan view of the view of FIG. 4A.
Figure 4C:
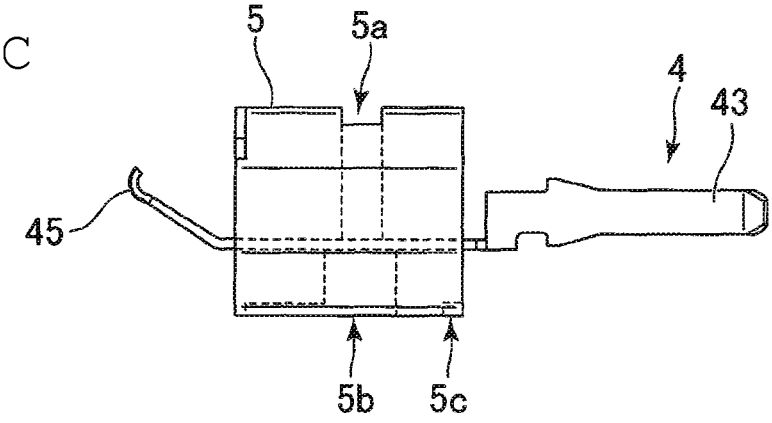
FIG. 4C is a side view of the view of FIG. 4A.

The insulating member 5 illustrated in FIGS. 4A-C is made of an insulating material and integrally formed with the signal terminal 4. The insulating member 5 is formed in a column shape that encloses the main body part 41 of the signal terminal 4, and the center axis direction thereof faces the front to back direction. In the first embodiment, the insulating member 5 is formed in an octagonal column shape. An upper hole 5*a* and a lower hole 5*b* made by supporting the signal terminal 4 at the time of molding is formed on the insulating member 5. In addition, a recessed part 5*c* is formed on the front end part of the lower surface of the insulating member 5.

Figure 5A:
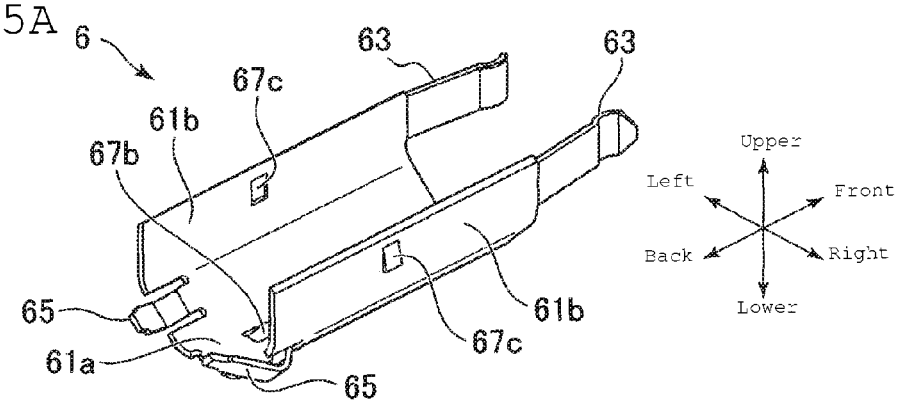
FIG. 5A is a perspective view of a first semi cylindrical part included in the connector of FIG. 1A.
Figure 5B:
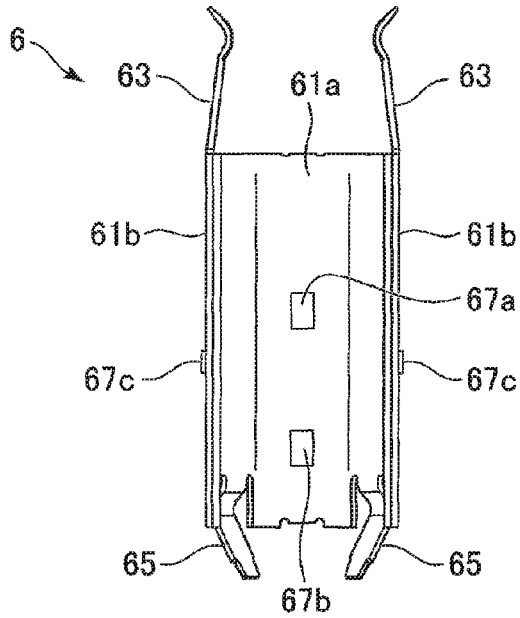
FIG. 5B is a plan view of the first semi cylindrical part of FIG. 5A.
Figure 5C:
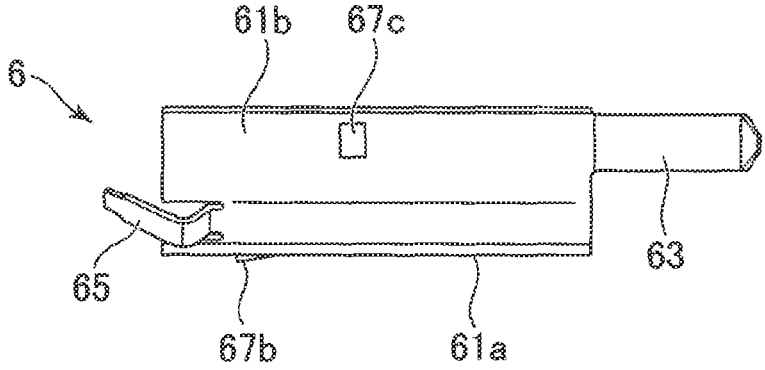
FIG. 5C is a side view of the first semi cylindrical part of FIG. 5A.

The first semi cylindrical part 6 illustrated in FIGS. 5A-C is made of a conductive material and formed by folding a stamped metal plate. The first semi cylindrical part 6 is formed in a semi cylindrical shape that opens upward having a center axis direction in the front to back direction. In the first embodiment, the first semi cylindrical part 6 is folded into a half octagon cylinder shape so as to follow along the outer circumference surface of the insulating member 5.

A pair of contact arms 63 that extend forward are provided on the front side of the first semi cylindrical part 6, and contact a ground conductor of the coaxial cable 9 illustrated in FIGS. 1A-B. The contact arms 63 are provided on the front side of both end parts 61*b* of the circumferential direction of the first semi cylindrical part 6 and can flexibly deform in mutually separating directions. The contact arm 65, bent in an "L" shape, is provided on the back side of the first semi cylindrical part 6, and contacts a conductor on a circuit board (not illustrated).

Provided in the center part 61*a* of the circumferential direction of the first semi cylindrical part 6 is the raised part 67*a* that protrudes upward and the raised part 67*b* that protrudes downward. The raised part 67*a* is provided in the center of the front to back direction and is slightly bent facing upward where the insulating member 5 is placed. The raised part 67*b* is provided rearward of the raised part 67*a* and is slightly bent facing downward. Further, a raised part 67*c* that protrudes facing laterally outward is provided near the center of the front to back direction on both end parts 61*b* of the circumferential direction of the first semi cylindrical part 6.

Figure 6A:
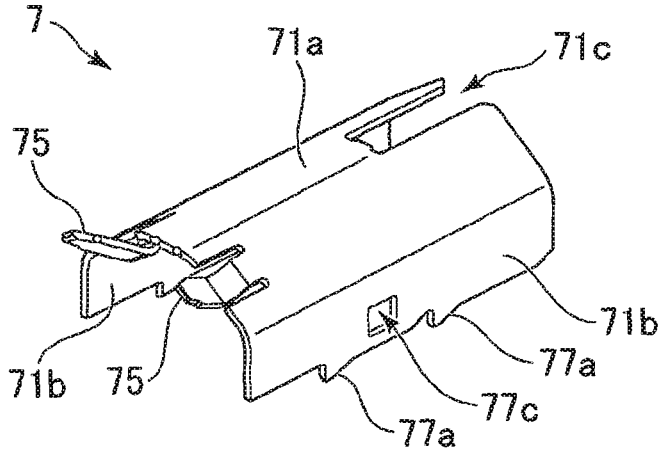
FIG. 6A is a perspective view of a second semi cylindrical part included in the connector of FIG. 1A.
Figure 6B:
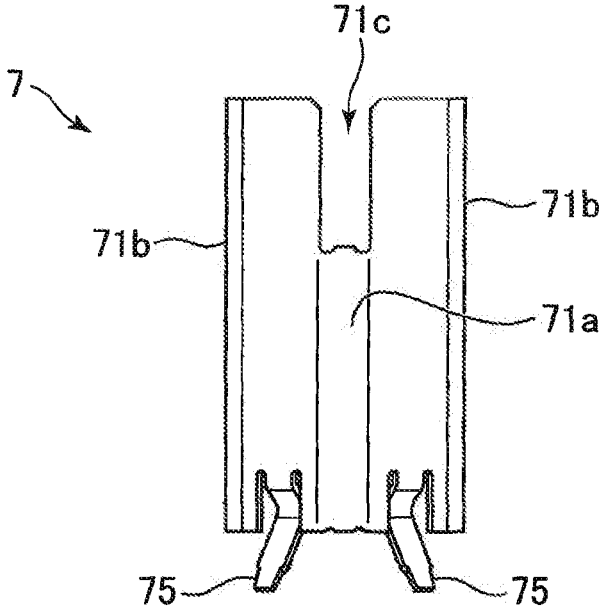
FIG. 6B is a plan view of the second semi cylindrical part of FIG. 6A.
Figure 6C:
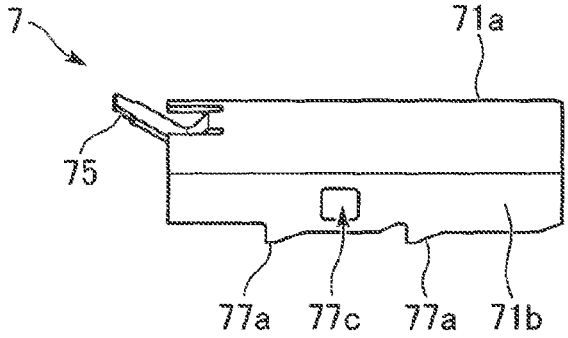
FIG. 6C is a side view of the second semi cylindrical part of FIG. 6A.

The second semi cylindrical part 7 illustrated in FIGS. 6A-C is made of a conductive material and formed by folding a stamped metal plate in a semi cylindrical shape that opens downward with the center axis direction facing in the front to back direction and forms the upper half of the cylindrical main body of the ground terminal 8. In the first embodiment, the second semi cylindrical part 7 is folded into a half octagon cylinder shape to follow along the outer circumference surface of the insulating member 5.

A slit 71*c*, extending rearward from the front end, is formed in the center part 71*a* of the circumferential direction of the second semi cylindrical part 7. The contact arm 75 that has been bent in an "L" shape is provided on the back side of the second semi cylindrical part 7 and contacts a conductor provided on the surface of a circuit board not illustrated. A plurality of pawl parts 77*a* projected in the in-plane direction is provided on both end parts 71*b* of the circumferential direction of the second semi cylindrical part 7. Further, a hole part 77*c* that penetrates through in the plate thickness direction is provided near the center of the front to back direction of both end parts 71*b*.

Figure 7A:
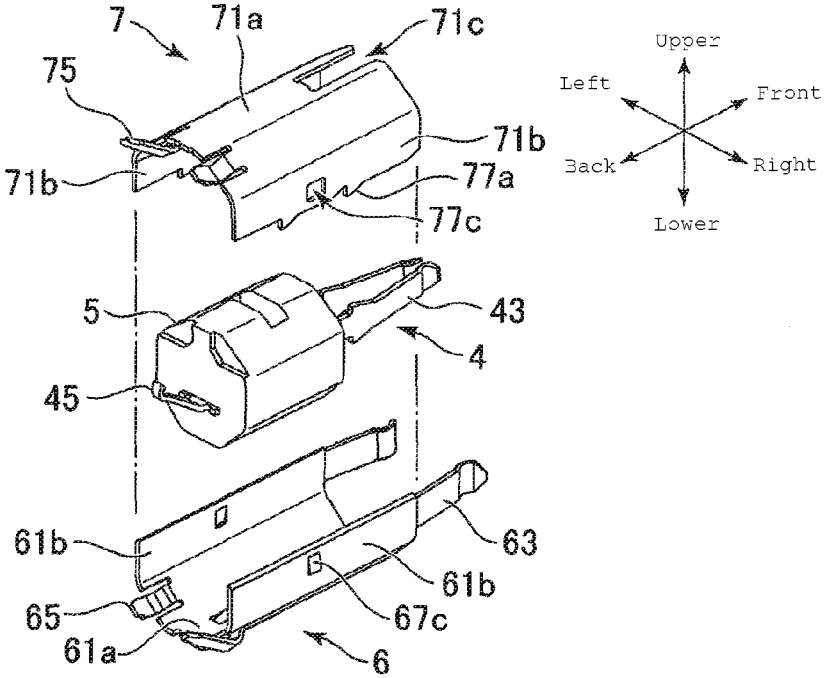
FIG. 7A is a perspective view illustrating the assembly of an assembly included in the connector of FIG. 1A.
Figure 7B:
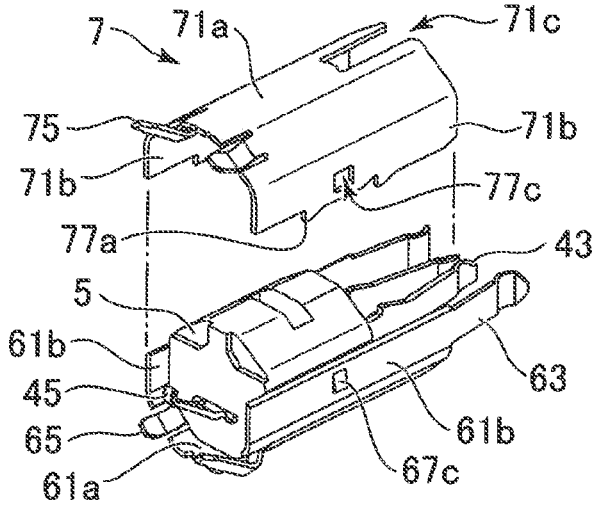
FIG. 7B is a perspective view illustrating the assembly of the assembly of FIG. 7A.
Figure 7C:
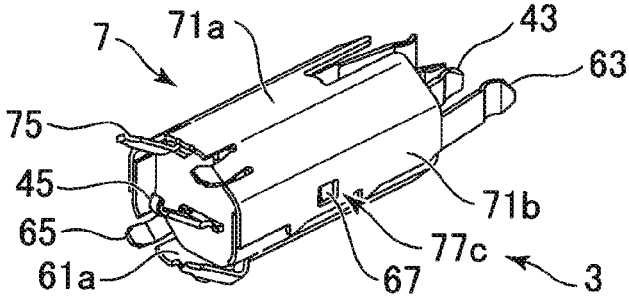
FIG. 7C is a perspective view illustrating the assembly of the assembly of FIG. 7A.

FIGS. 7A-C are perspective views illustrating the assembly of an assembly 3. The assembly 3 is completed by attaining a first step where the first semi cylindrical part 6 is attached to the lower half of the insulating member 5 and a second step where the second semi cylindrical part 7 is attached to the upper half of the insulating member 5.

In the first step, illustrated in FIG. 7B, the first semi cylindrical part 6 fits with the insulating member 5 in a flexibly deformed state such that the gaps of both end parts 61*b* of the circumferential direction are widened. The width of the lateral direction of the insulating member 5 is set to be wider than the gap of both end parts 61*b* of the circumferential direction of the first semi cylindrical part 6 in a normal state. Therefore, when the insulating member 5 is pushed to the inner side of the first semi cylindrical part 6, the insulating member 5 causes the first semi cylindrical part 6 to flexibly deform so as to press wider both end parts 61*b* laterally outward. By this, the first semi cylindrical part 6 generates an elastic recovery force so as to sandwich the insulating member 5 laterally inward by both end parts 61*b*. At this time, the raised part 67*a* (see FIG. 5B), that protrudes facing upward, is provided in the center part 61*a* of the circumferential direction of the first semi cylindrical part 6 engages with the recessed part 5*c* (see FIG. 4C) provided on the lower surface of the insulating member 5.

In the second step, illustrated in FIG. 7C, the second semi cylindrical part 7 fits with the insulating member 5 that is fit with the first semi cylindrical part 6 in a flexibly deformed state such that the gaps of both end parts 71*b* of the circumferential direction are widened. This time, both end parts 71*b* of the second semi cylindrical part 7 overlap to the outer side of the diameter direction of the first semi cylindrical part 6. The width of the lateral direction of the first semi cylindrical part 6 fit with the insulating member 5 is set to be wider than the gap of both end parts 71*b* of the circumferential direction of the second semi cylindrical part 7 in a normal state. Therefore, when the first semi cylindrical part 6 and the insulating member 5 are pushed to the inner side of the second semi cylindrical part 7, these cause the second semi cylindrical part 7 to flexibly deform so as to press wider both end parts 71*b* laterally outward. By this, the second semi cylindrical part 7 generates an elastic recovery force to sandwich the first semi cylindrical part 6 and the insulating member 5 laterally inward by both end parts 71*b*.

At this time, the raised part 67*c* that protrudes facing laterally outward is provided on both end parts 61*b* of the circumferential direction of the first semi cylindrical part 6 engages with the hole part 77*c* provided on both end parts 71*b* of the circumferential direction of the second semi cylindrical part 7. In addition, the pair of contact arm's 43 provided on the front side, and both end parts 71*b* of the circumferential direction of the second son the cynical part 7 overlap to the outer side of the diameter direction on both end parts 61*b* of the circumferential direction of the first semi cylindrical part 6. Therefore, the base area of the pair of contact parts 43 is reinforced, and the elastic recovery force is increased.

Figure 8:
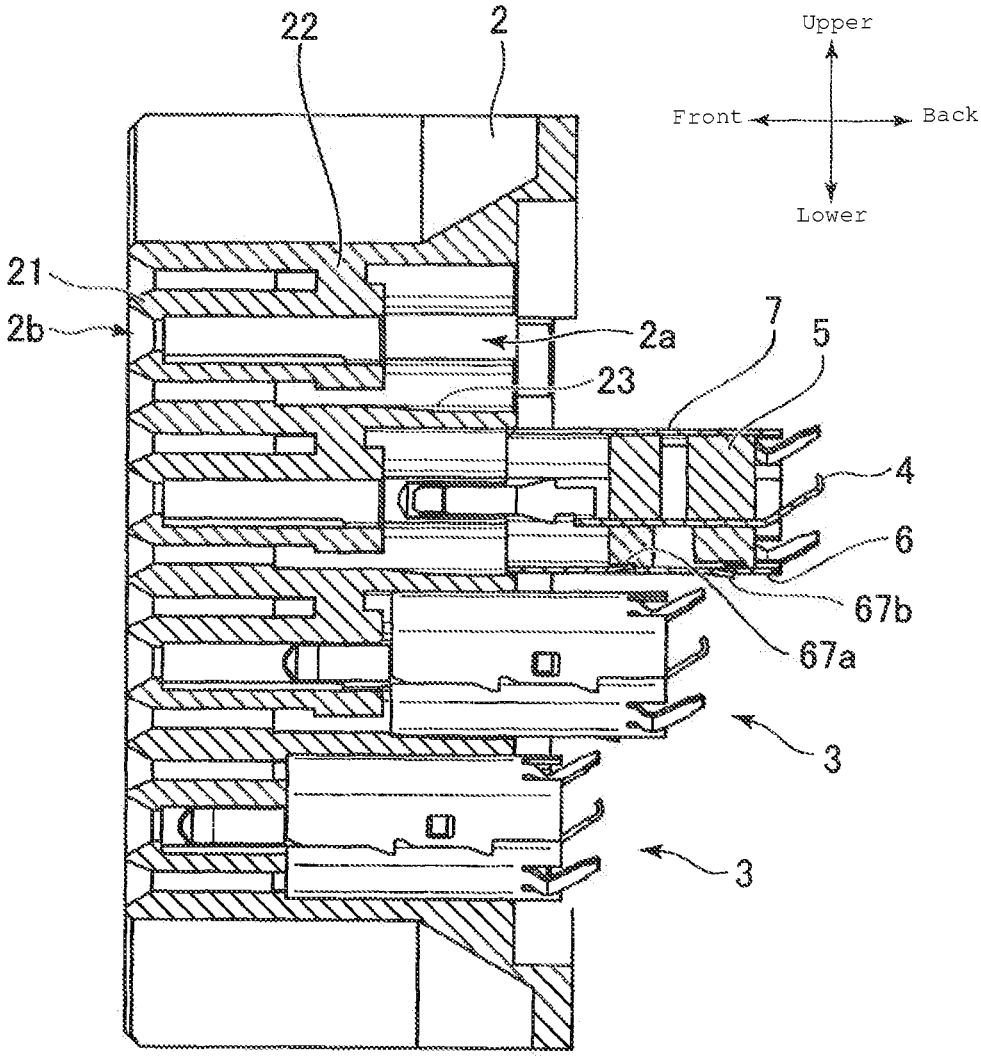
FIG. 8 is a cross-sectional view illustrating the insertion of the assembly of FIG. 7A in the connector of FIG. 1A.

FIG. 8 is a cross-sectional view illustrating the insertion of the assembly 3. The first semi cylindrical part 6, arranged on the lower end of the assembly 3 where the assembly 3 is inserted midway into the insertion hole 2*a* of the enclosure 2, contacts the slope 23 provided on the lower side of the inner wall of the insertion hole 2*a*. The first semi cylindrical part 6 is guided upward by the slope 32 as the insertion of the assembly 3 advances, and by this, the gap between the center part 61*a* of the circumferential direction of the first semi cylindrical part 6 and the center part 71*a* of the circumferential direction of the second semi cylindrical part 7 narrows. Note that the slope 23 may also be provided on the side of the second semi cylindrical part 7.

In addition, when the assembly 3 is inserted into the insertion hole 2*a* of the enclosure 2, the pair of contact arms 43 provided on the front side of the signal terminal 4 is inserted into the insertion holes 2*b* of the holding part 21 provided on the inner side of the insertion hole 2*a* of the enclosure 2. At this time, the pawl part 43*a* provided on the contact arm 43 penetrates into the inner wall of the holding part 21. By this, the release of the signal terminal 4 and the insulating member 5 integrally provided with this, is suppressed.

Further, the raised part 67*a* provided on the first semi cylindrical part 6 engages with the recessed part 5*c* provided on the insulating member 5. Therefore, the release of the signal terminal 4 and the insulating member 5 is suppressed while the release of the first semi cylindrical part 6 is also suppressed. Also, the raised part 67*b* of the first semi cylindrical part 6 protruding in the reverse direction to that of the insulating member 5 contacts the inner wall of the insertion hole 2*a* of the enclosure 2. Thus, the slant of the first semi cylindrical part 6 is suppressed.

Figure 9:
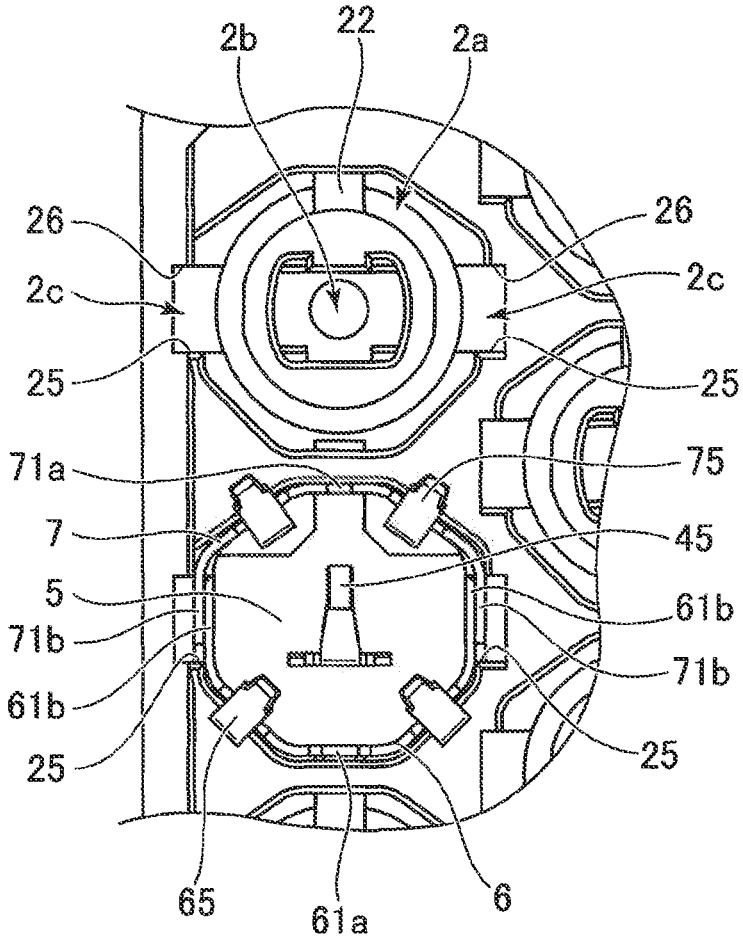
FIG. 9 is a front view illustrating the insertion of the assembly of FIG. 7A.

Additionally, when the assembly 3 is inserted into the insertion hole 2*a* of the enclosure 2, the second semi cylindrical part 7 arranged on the upper end of the assembly 3 proceeds forward while contacting the upper side of the inner wall of the insertion hole 2*a*. As illustrated in FIG. 9, the center part 71*a* of the circumferential direction of the second cylindrical part 7 contacts the upper side of the inner wall of the insertion hole 2*a* while both end parts 71*b* of the circumferential direction of the second semi cylindrical part 7 protrude to abut the corner part 25 provided on the inner wall of the insertion hole 2*a*. Downward displacement of the second cylindrical part 7 is suppressed by the corner part 25 that functions as a stopper. By this, the second cylinder go part 7 is inserted into the insertion hole 2*a* without vertical displacement.

Furthermore, the pawl part 77*a* provided on both end parts 71*b* of the circumferential direction of the second semi cylindrical part 7 penetrates into the corner part 25. By this, release of the second semi cylindrical part 7 is suppressed. Furthermore, a coupling 22 that joins the inner wall of the insertion hole 2*a* and the holding part 21 is inserted into the slip 71*c* provided on the center part 71*a* of the circumferential direction of the second semi cylindrical part 7.

According to the first embodiment explained above, the left and right portions of gaps, relative to the insulating member 5, formed between the ground terminal 8 and the insulating member 5 are reduced by the elastic recovery force of the first semi cylindrical part 6 and the second semi cylindrical part 7, and the size of the variance can be suppressed. In addition, the top and bottom portions of gaps, relative to the insulating member 5, formed between the ground terminal 8 and the insulating member 5 are reduced by the slope 23 provided on the inner wall of the insertion hole 2*a* of the enclosure 2, and the size of the variance can be suppressed.

Figure 10A:
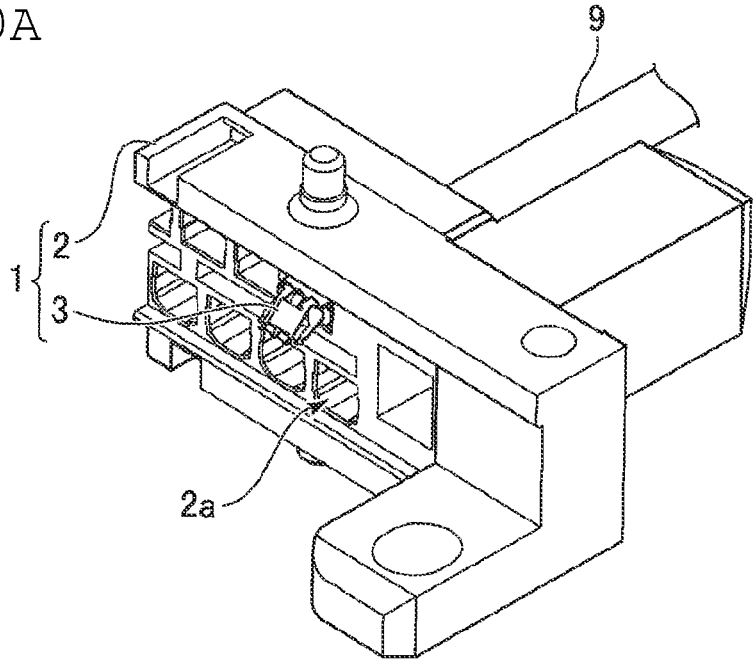
FIG. 10A is a perspective view of a connector of the Present Disclosure.
Figure 10B:
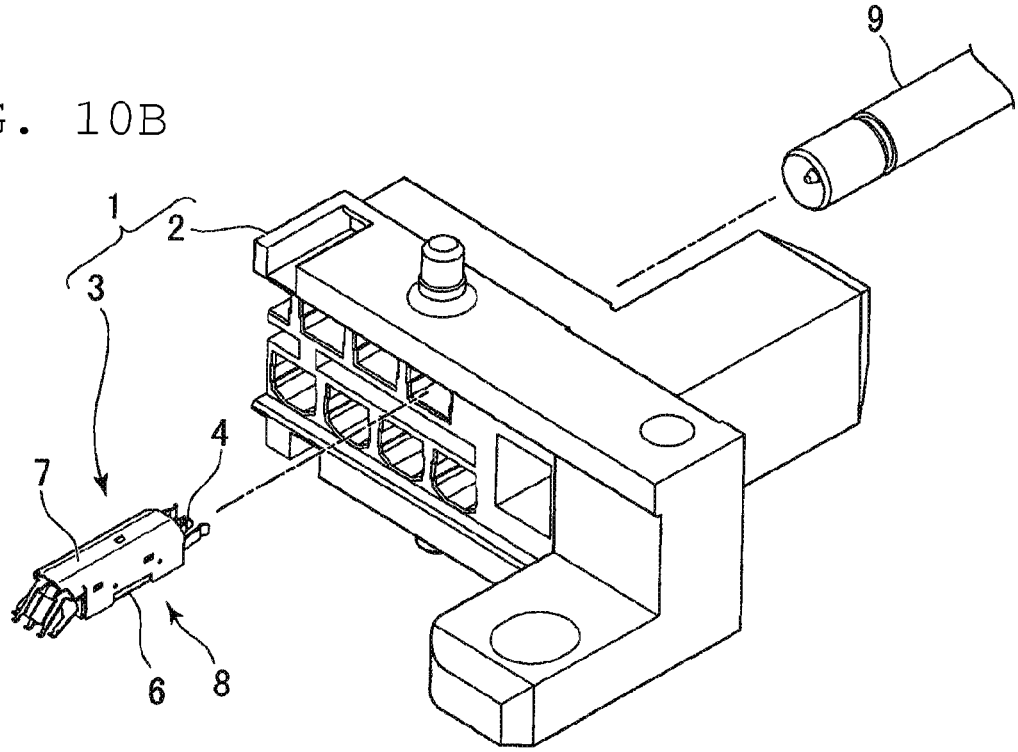
FIG. 10B is a blown up perspective view of the connector of FIG. 10A.
Figure 11A:
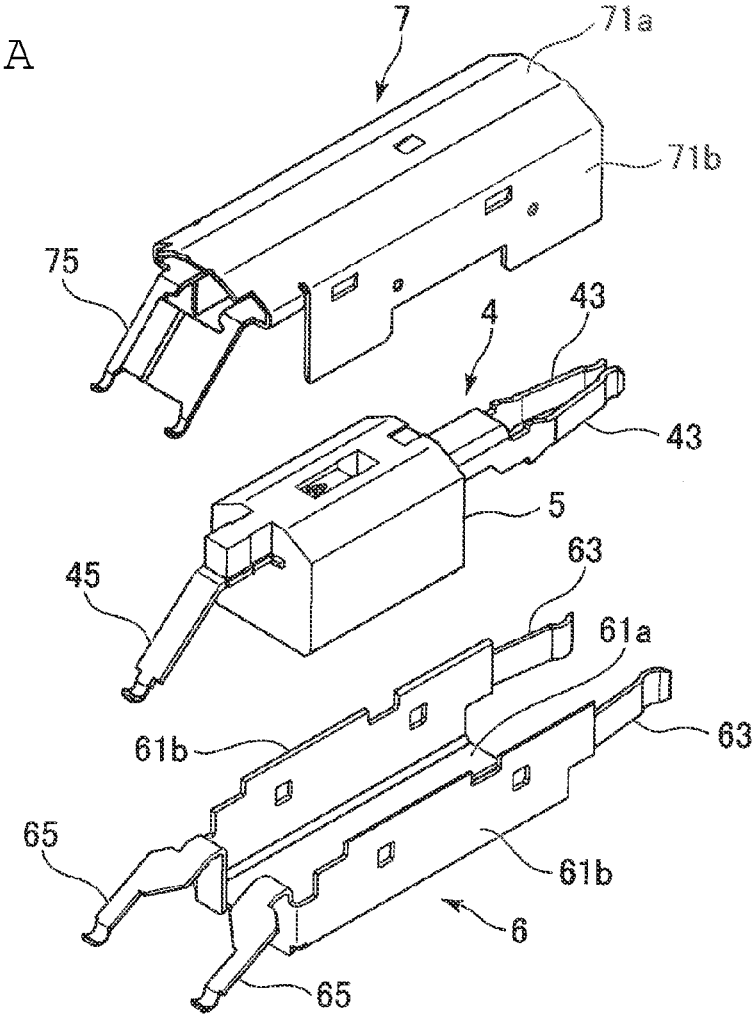
FIG. 11A is a perspective view illustrating the assembly of an assembly included in the connector of FIG. 10A.
Figure 11B:
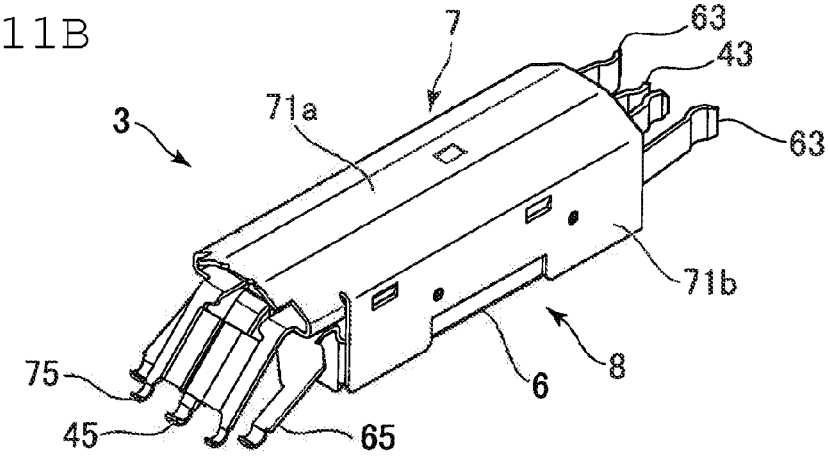
FIG. 11B is a perspective view illustrating the assembly of the assembly of FIG. 11A.
Figure 12A:
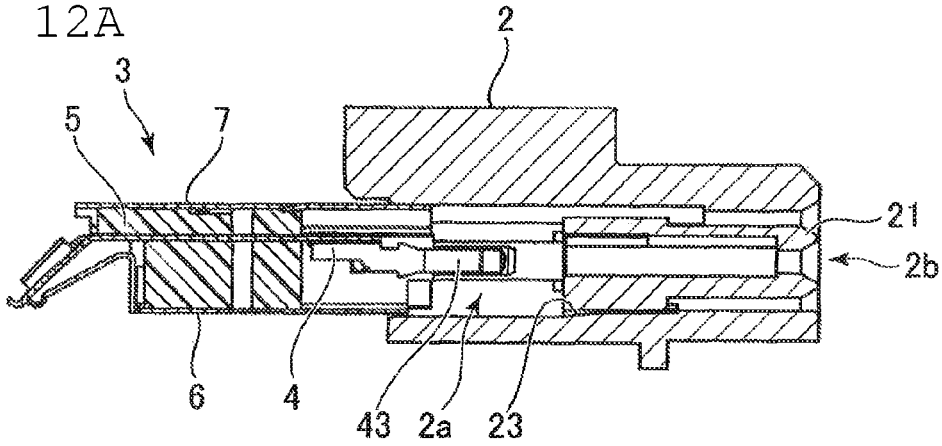
FIG. 12A is a cross-sectional view illustrating the insertion of the assembly of FIG. 11A in the connector of FIG. 10A.
Figure 12B:
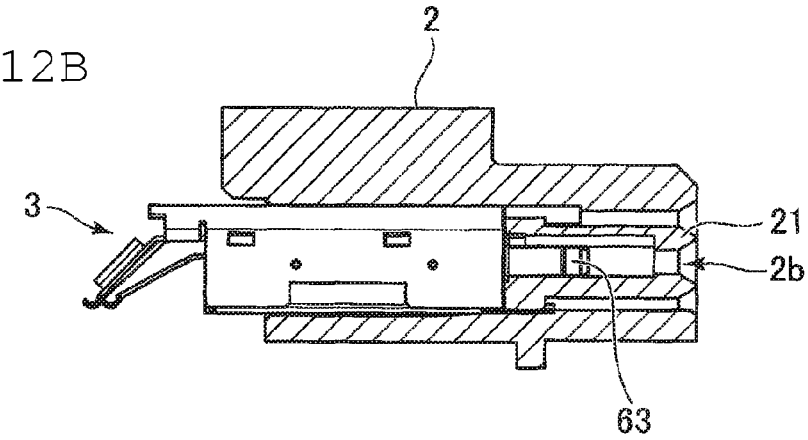
FIG. 12B is a cross-sectional view illustrating the insertion of the assembly of FIG. 11A in the connector of FIG. 10A.
Figure 12C:
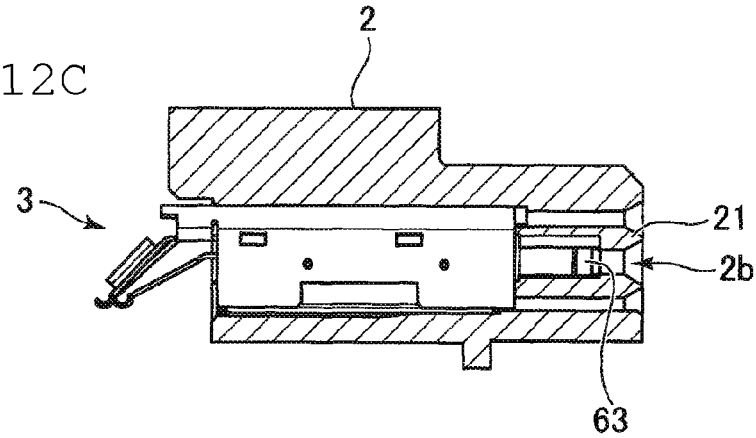
FIG. 12C is a cross-sectional view illustrating the insertion of the assembly of FIG. 11A in the connector of FIG. 10A.

Referring to FIGS. 10-2, a connector 10 is attached to the edge portion of a circuit board (not illustrated). Contact arms 43, 65, and 75 respectively provided on the rear side of the signal terminal 4, the first semi cylindrical part 6, and the second semi cylindrical part 7 are folded so as to each contact a plurality of conductors provided on both surfaces of a circuit board not illustrated. The lower half of the insulating member 5 is formed in a rectangular hexagonal column shape, and the first semi cylindrical part 6 and the second semi cylindrical part 7 are folded along the outer circumference surface of the insulating member 5. Also in the second embodiment, the left and right portions of gaps, relative to the insulating member 5, formed between the ground terminal 8 and the insulating member 5 are reduced by the elastic recovery force of the first semi cylindrical part 6 and the second semi cylindrical part 7, and the top and bottom part relative to the insulating member 5 is reduced by the slope 23 provided on the inner wall of the insertion hole 2*a* of the enclosure 2.

Detailed descriptions where the same reference numeral is attached for configurations that correspond to the first embodiment will be omitted.

Figure 13:
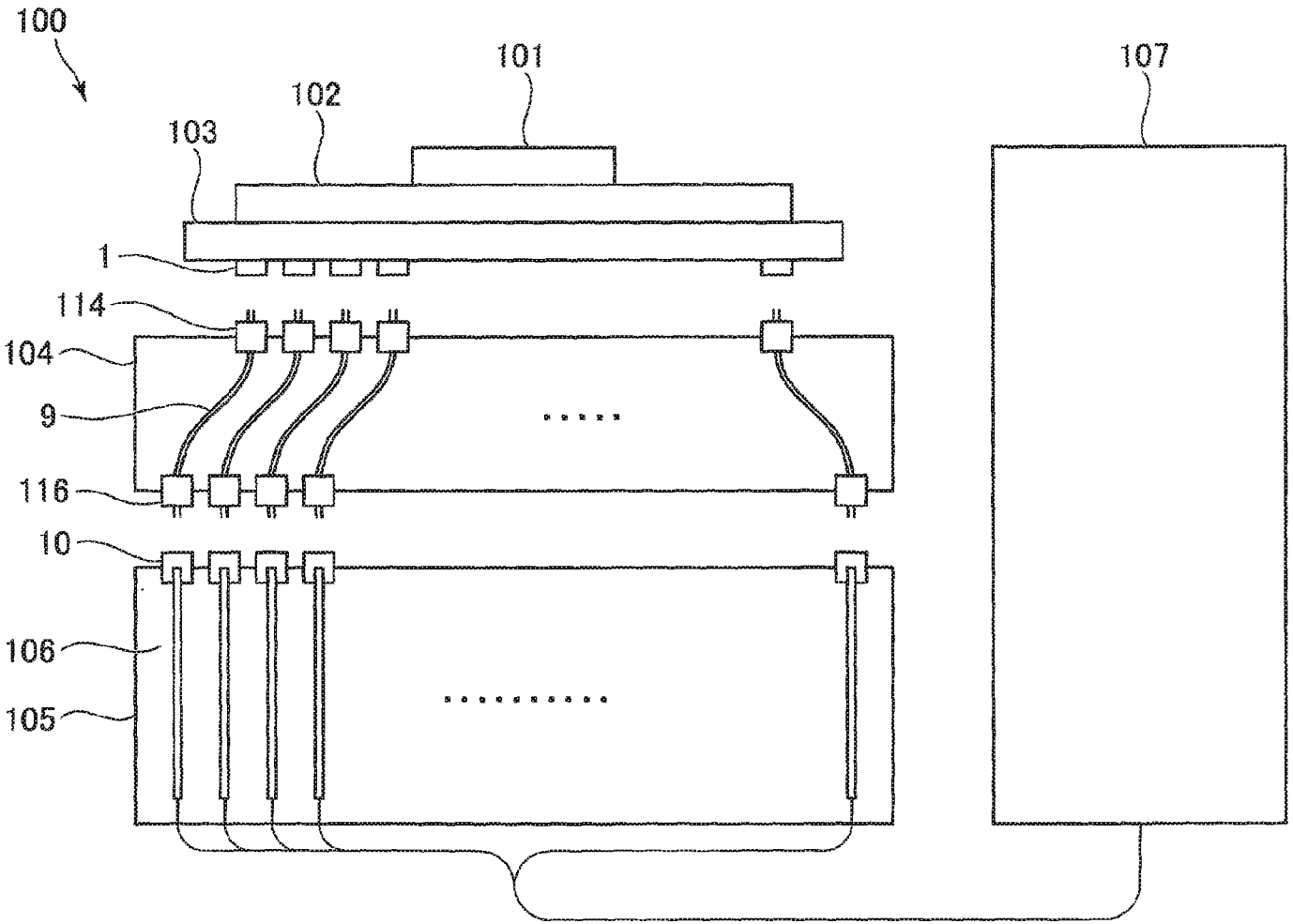
FIG. 13 is a diagram schematically illustrating a semiconductor test device of the Present Disclosure.

Referring to FIG. 13, a semiconductor 101 is mounted on a device socket 102 arranged on a performance board 103. A plurality of connectors 1 is attached to the bottom surface of the performance board 103. The semiconductor test device 100 is provided with a motherboard 104 that includes a plurality of clutch cables 9. A plurality of holders 114 are provided on the top part of the motherboard 104. Each holder 114 holds a signal conductor and a ground conductor of a coaxial cable 9. When the performance board 103 is arranged on the motherboard 104, the signal conductor and the ground conductor of the coaxial cable 9 are inserted into the connector 1. Further, a plurality of holders 116 are arranged on the bottom part of the motherboard 104. Each holder 116 holds a signal conductor and a ground conductor of a coaxial cable 9. The semiconductor test device 100 is provided with a test head 105 having a plurality of test modules 106. A connector 10 is attached to the edge of each test module 106, and when the motherboard 104 is arranged on the test head 105, the signal connector and the ground connector provided on the bottom end of the coaxial cable 9 are inserted into each connector 10. Each test module 106 is connected to a test device main body 107 where test signals are generated according to instructions received from the test device main body 107 and output to the semiconductor 101.

Note that in the above embodiments, both end parts 71*b* of the second semi cylindrical part 7 overlap to the outer side of the diameter direction of the first semi cylindrical part 6. However, both end parts 61*b* of the first semi cylindrical part 6 may be made to overlap to the outer side of the diameter direction of the second semi cylindrical part 7. Furthermore, the contact arm 63, or the raised parts 67*a*, 67*b*, and 67*c*, slit 71*c*, pawl part 77*a* and the like may be provided on either of the first semi cylindrical part 6 or the second semi cylindrical part 7.

While a preferred embodiment of the Present Disclosure is shown and described, it is envisioned that those skilled in the art may devise various modifications without departing from the spirit and scope of the foregoing Description and the appended Claims.

What is claimed is:

1. A connector, comprising:

a signal terminal having a main body that extends in one direction and a contact arm provided on each side of the extension direction of the main body for contacting another conductor;

an insulating member arranged so as to enclose the main body part of the signal terminal;

a ground terminal having a cylindrical main body of a cylindrical shape arranged so as to enclose the insulating member, a contact arm provided on each side of the center axis direction of the cylindrical main body for contacting another conductor, wherein the cylindrical main body includes a first semi-cylindrical part and a second semi-cylindrical part having semi-cylindrical shapes, and the first semi-cylindrical part and the second semi-cylindrical part make a cylindrical shape as a whole by both end parts of the circumferential direction being assembled so as to mutually overlap; and an enclosure having an insertion hole formed where an assembly of the signal element, the insulating member, and the ground terminal are inserted.

2. The connector of claim 1, wherein the first semi cylindrical part fits with the insulating member in a flexibly deformed state such that the gaps of both end parts of the circumferential direction are widened.

3. The connector of claim 2, wherein the second semi cylindrical part fits with the insulating member that is fit with the first semi cylindrical part, in a flexibly deformed state such that the gaps of both end parts of the circumferential direction are widened.

4. The connector of claim 3, wherein a slope is provided on the inner side of the insertion hole of the enclosure that guides at least one of the first semi cylindrical part or the second semi cylindrical part as the insertion of the assembly advances so that the gaps of the mutual center parts of the circumferential direction of the first semi cylindrical part and the second semi cylindrical part narrow.

5. The connector of claim 4, wherein the slope contacts the first semi cylindrical part and guides the first semi cylindrical part towards the second semi cylindrical part.

6. The connector of claim 5, wherein a stopper is provided on the inner side of the insertion hole of the enclosure that regulates the movement of the second semi cylindrical part to the first semi cylindrical part.

7. The connector of claim 6, wherein a pawl part that penetrates into the stopper is provided on both end parts of the circumferential direction of second semi-cylindrical part.

8. The connector of claim 7, wherein the contact arm is provided on the part that overlaps the second semi cylindrical part of the first semi cylindrical part and can be flexibly deformed to the outer side of the diameter direction.

9. The connector of claim 8, wherein a raised part provided on one of an outer circumference surface of the insulating member or an inner circumference surface of the first semi cylindrical part is fitted into a recessed part provided on the other.

10. The connector of claim 9, wherein the insulating member is integrally molded with the signal terminal.

11. A performance board, comprising the connector of claim 1.

12. A motherboard, comprising the connector of claim 1.

13. A semiconductor test device, comprising the connector of claim 1.

* * * * *